United States Patent [19]

Wakabayashi

[11] 4,292,897

[45] Oct. 6, 1981

[54] TROLLEY ROTATION STABILIZING DEVICE

[75] Inventor: Takao Wakabayashi, Toyonaka, Japan

[73] Assignee: Nakanishi Metal Works Co., Ltd., Osaka, Japan

[21] Appl. No.: 33,254

[22] Filed: Apr. 25, 1979

[30] Foreign Application Priority Data

Apr. 26, 1978 [JP] Japan ..... 53-56536[U]

[51] Int. Cl.[3] ..... B61B 3/00; B61B 13/12; B61C 13/04; B61F 5/00

[52] U.S. Cl. ..... 104/172 S; 105/156

[58] Field of Search ..... 104/172 S; 105/156

[56] References Cited

U.S. PATENT DOCUMENTS

| | | | |
|---|---|---|---|
| 924,154 | 6/1909 | Ferris | 105/156 X |
| 2,512,034 | 6/1950 | Moore | 105/156 |
| 3,411,457 | 11/1968 | Gutsch, Jr. | 104/172 S |

*Primary Examiner*—John P. Silverstrim

*Assistant Examiner*—Howard Beltran

*Attorney, Agent, or Firm*—Armstrong, Nikaido, Marmelstein & Kubovcik

[57] ABSTRACT

A device for preventing turn-around motions of free trolleys in a power-and-free conveyor having a power rail and a free rail is provided. The device includes a connecting link interconnecting the free trolleys and having holes as well as turn-preventing members on the opposite ends thereof. Each of the trolleys is provided with a downwardly directed rod from the trolley, the rod rotatably passing through a hole of the connecting link and having a stopper at its lower end. The stoppers receive the connecting link when the free trolleys are on the free rail. Each of the turn-preventing members has an engaging portion which extends upward. Each of the engaging portions engages with the lower portion of a free trolley when the free trolley is taken off from the free rail. Thus, the turn-around motions of the free trolleys are prevented and the free trolleys are in the position where their directions are the same as that in which the connecting link extends.

6 Claims, 5 Drawing Figures

TROLLEY ROTATION STABILIZING DEVICE

BACKGROUND OF THE INVENTION

1. Field of the Invention

This invention relates to a device for preventing turn-around-motions of the free trolleys in a power-and-free conveyor when the free trolleys are taken off from a free rail.

2. Description of the Prior Art

A conventional power-and-free conveyor includes a power rail, a free rail provided below the power rail and a carrier which travels on the free rail. The carrier comprises a pair of front and rear free trolleys movably supported by the free rail, and a connecting link which interconnects the free trolleys. Such power-and-free conveyor transports articles such as clothes, which are hung on the carrier, in such places as distribution center, warehouse, production flow line, etc., and the carriers are taken off from and put on the free rail by a worker in many places of a conveyor line. On the other hand, the opposite ends of the connecting link are horizontally pivotally connected to the free trolleys and the free trolleys can freely turn or swing around in any direction in a horizontal plane, thus enabling the carrier to travel along the curved portion of the rails. This construction causes the situation that the directions of the free trolleys are different from each other and also from the direction in which the connecting link extends, when the carriers are taken off from the free rail. Accordingly, to position the carrier on the free rail, it is necessary to put the trolleys in the same direction as that of the connecting link. Righting the direction of the free trolleys requires much trouble and lowers efficiency of the works such as taking off and putting on the carriers, introducing the carriers into the conveyor line, exchanging the carriers, etc.

SUMMARY OF THE INVENTION

This invention provides a device which prevents turn-around motions of free trolleys when a carrier is taken off from a free rail.

The device of the present invention comprises a connecting link which interconnects the free trolleys, downwardly directed rods from the free trolleys, one from each trolley, each of which has a stopper at its lower end, and turn-preventing means for preventing turn-around motions of the free trolleys each of which is provided on either a free trolley or one end of the connecting link. The connecting link has holes on the opposite ends thereof and the rods rotatably pass through the holes. The stoppers of the rods receive the connecting link when the free trolleys are on the free rail. Thus, the free trolleys can freely swing or turn around in a horizontal plane, so that a carrier which comprises the free trolleys and the connecting link, can travel along the curved portion of the rail. The turn-preventing means prevent the turn-around motions of the free trolleys and the free trolleys are held in the same direction as that in which the connecting link extends, when the free trolleys are taken off from the free rail. Accordingly, it does not need to put the free trolleys in the same direction as that of the connecting link for placing the carrier on the free rail, so that workers can save trouble and that efficiency of the works increases.

BRIEF DESCRIPTION OF THE DRAWINGS

Other features and advantages of the invention will appear from the description to follow of embodiments disclosed in the accompanying drawings.

In the drawings.

DETAILED DESCRIPTION OF THE PREFERRED EMBODIMENT

Figure 1:
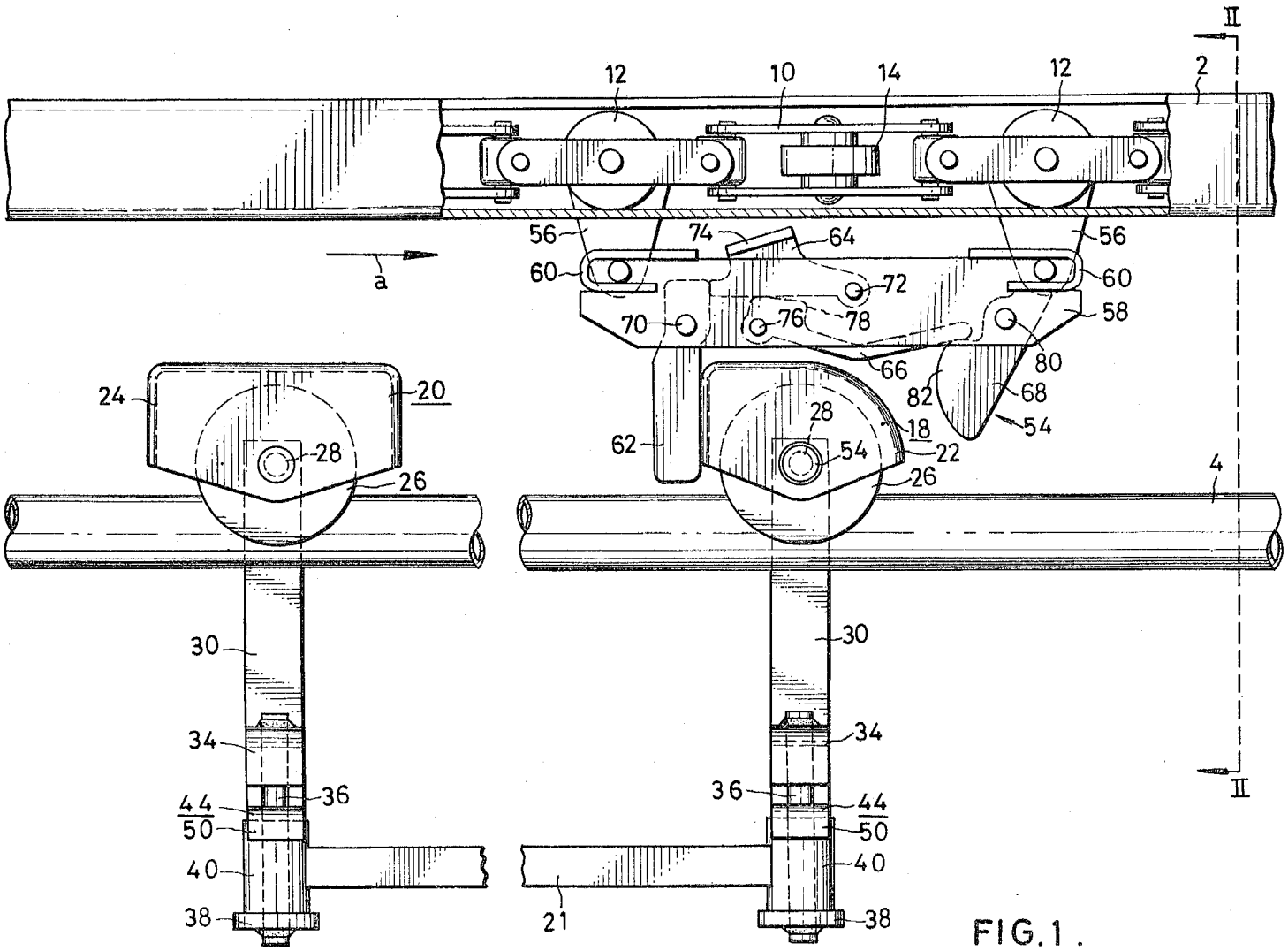
FIG. 1 is a side elevation showing a power-and-free conveyor.
Figure 2:
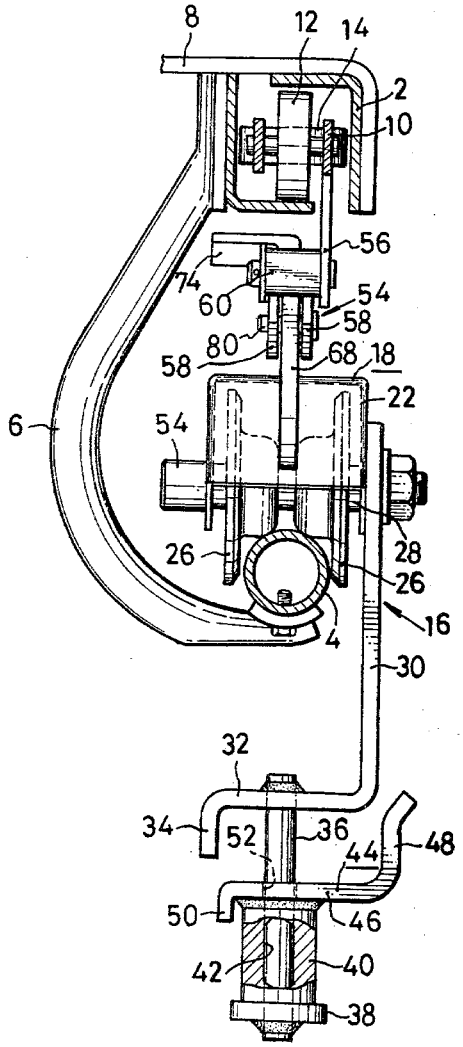
FIG. 2 is a view in section taken along the line II—II in FIG. 1.

Referring to FIGS. 1 and 2, a power-and-free conveyor includes a power rail 2 and a free rail 4 spaced vertically at a predetermined distance from each other, the free rail 4 being provided below the power rail 2. The power rail 2 comprises a pair of L-shaped steel members being arranged substantially in the form of a square-shaped cross section. The free rail 4 comprises a steel pipe. The rails 2 and 4 are connected to each other by connecting arms 6 arranged at a specified interval and are suspended by supporting members 8. A drive chain 10 in the power rail 2 has pairs of vertical power trolleys 12 and horizontal power trolleys 14 positioned between the pairs of vertical power trolleys 12, each trolley being rollable on the power rail 2. The power trolleys 12 and 14 are positioned at intervals along the drive chain 10. The drive chain 10 is driven at all times in the direction of an arrow a shown in FIG. 1.

A carrier 16 which travels on the free rail 4, comprises a pair of front and rear free trolleys 18 and 20, and a connecting link 21 which interconnects free trolleys 18 and 20. The front and rear trolleys 18 and 20 have front and rear covers 22 and 24, respectively, the bottoms of which are opened. Pairs of wheels 26 in the covers 22 and 24 are rotatably mounted on axles 28, the axles 28 being fixedly supported to the covers 22 and 24. The free trolleys 18 and 20 are provided with downwardly directed arms 30 the upper ends of which are fixed to the covers 22 and 24 at one end of each axle 28. Each of the arms 30 has a horizontally extending portion 32 at its lower end and an engaging portion 34, the engaging portion 34 projecting downward from the free end of the portion 32. To the center of the horizontal portion 32, a rod 36 is welded at its upper end, which rod downwardly extends straight and has a stopper 38 at its lower end. The connecting link 21 is provided with cylinders 40 at the opposite ends thereof, each of the cylinders 40 having a hole 42. Turn or rotation preventing members 44 are rigidly secured onto the upper ends of the cylinders 40 by means of welding, respectively, each of the members 44 comprising a horizontal portion 46, an engaging portion 48 projecting upward from one end of the portion 46, and a downwardly projecting portion 50 at the other end of the portion 46. The horizontal portion 46 has a hole 52 which coincides with the hole 42. The upper end of the engaging portion 48 expands outward. The rod 36 rotatably passes through the holes 42 and 52. Thus, the opposite ends of the link 21 are horizontally pivotally connected to the lower ends of the arms 30 by means of the rods 36 and cylinders 40. The front free trolley 18 has a stop pin 54 extending outward from the other end of the axle 28.

A propelling member 54 is attached to the drive chain 10 by means of supporting arms 56 at the points where the power trolleys 12 are provided. The propelling member 54 comprises a pair of side plates 58 arranged in parallel with each other and U-shaped connecting pieces 60 which interconnect the side plates 58. The propelling member 54 has a pusher dog 62, a stopper 64, a stopper raising lever 66, and a lever receiving piece 68, all of which are pivotally supported to the side plates 58. The pusher dog 62 is pivoted by a pin 70 at an upper portion thereof. The stopper 64 pivoted by a pin 72 at its front end, stops the pusher dog 62 in a vertical downwardly directed position by the engagement of its free end with the top of the pusher dog 62, whereupon the pusher dog 62 can engage with the front free trolley 18 so that the carrier 16 is driven together with the drive chain 10 in the direction of the arrow a. The stopper 64 has a pusher dog disengaging portion 74 extending outwardly therefrom. When the carrier 16 reaches the location where a stopping means (not shown) is disposed, the stopping means having a stopper raising member which is projectable into the path of travel of the pusher dog disengaging portion 74, the pusher dog disengaging portion 74 comes into contact with the stopper raising member which has already projected into the path and accordingly the stopper 64 is raised, whereupon the pusher dog 62 is released from the stopper 64 and disengaged from the trolley 18. As a result of that the carrier 16 is brought to a stop. The stopper raising lever 66 pivoted at its rear end by a pin 76, has at its rear portion an upwardly extending projection 78 for receiving and raising the stopper 64. The lever receiving piece 68 pivoted at its upper portion by a pin 80, has a receiving portion 82 on which the free end of the stopper raising lever 66 is received. The top of the lever receiving piece 68 is in contact with the connecting piece 60 to support the lever receiving piece 68 such that the piece 68 is obliquely directed rearwardly and downwardly.

Figure 3:
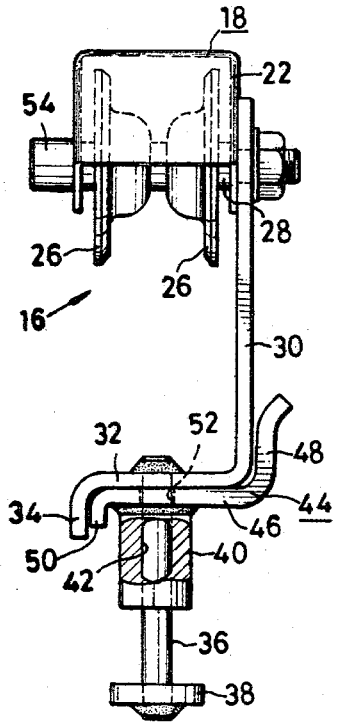
FIG. 3 is a front view showing a carrier which is taken off from a free rail.

As shown in FIGS. 1 and 2, the cylinders 40 of the link 21 are received on the stoppers 38 and the turn-preventing members 44 are spaced apart from the horizontal portions 32 of the arms 30, while the trolleys 18 and 20 are on the free rail 4 irrespectively as to whether the carrier 16 is traveling along the rail or not. In this situation, the front and rear free trolleys 18 and 20 can freely swing or turn around in the horizontal plane, so that there is no problem as to the travel of the carrier 16 along the curved portion of the rail. To raise and take off the carrier 16 from the free rail 4, the link 21 is lifted by a worker. In this case, the members 44 come into contact with the lower portions of the arms 30 respectively as shown in FIG. 3. The engaging portions 34, the horizontal portions 32 and the lower ends of the vertically directed bar portions of the arms 30 overlap with the downwardly projecting portions 50, the horizontal portions 46 and the engaging portions 48 of the members 44, respectively. As a result of that the front and rear trolleys 18 and 20 cannot turn around in the horizontal plane and are placed in the position where their directions are the same as that in which the connecting link 21 extends. Thus, it is not necessary to amend the direction of the trolleys 18 and 20 when the trolleys 18 and 20 are put on the free rail 4 by lifting the link 22.

Figure 4:
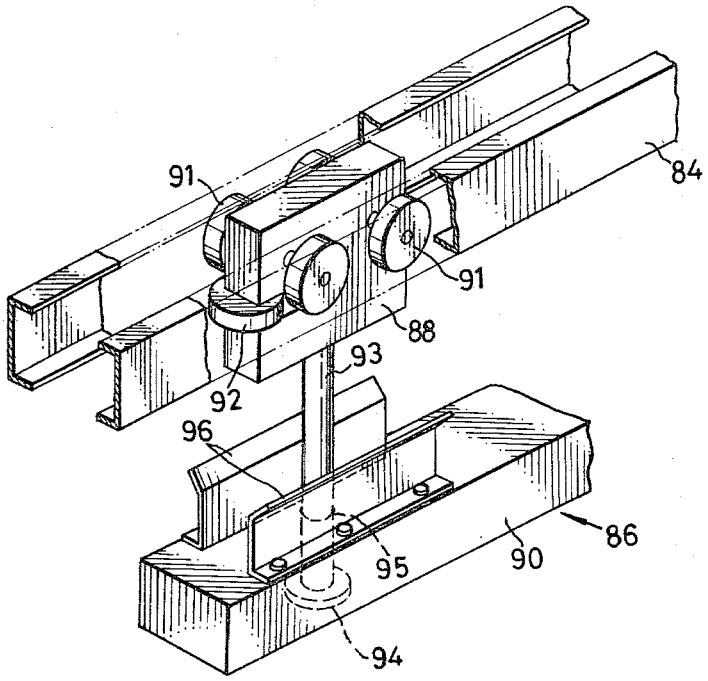
FIG. 4 is a perspective view showing a modified form of a power-and-free conveyor.
Figure 5:
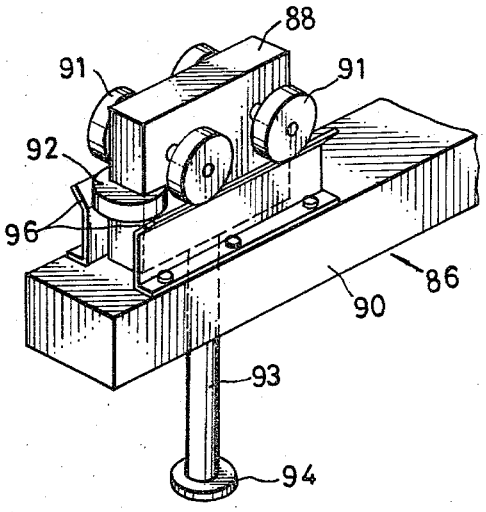
FIG. 5 is a perspective view showing a carrier shown in FIG. 4, the carrier being taken off from a free rail.

FIGS. 4 and 5 show another embodiment of this invention. A free rail 84 is constructed with a pair of lateral U-shaped steel members. A power rail and power trolleys are not illustrated. A carrier 86 comprises a front free trolley 88, a rear free trolley (not shown) and a connecting link 90 which interconnects the free trolleys. Each of the free trolleys has vertical rollers 91 in the free rail 84, horizontal rollers 92 for preventing a side-to-side swing motion, and a downwardly directed rod 93, the rod 93 having a stopper 94 at its lower end. The link 90 has holes 95 and is provided with a pair of vertical plates 96 arranged in parallel with each other on the opposite ends thereof, the plates 96 vertically extending upward and their upper end portions spreading outward. The rod 93 rotatably passes through the hole 95. When the carrier 86 travels along the rail 84, the opposite ends of the link 90 are received on the stoppers 94 as shown in FIG. 4. In this situation, the free trolleys 88 can freely turn around in the horizontal plane. However, when the carrier 86 is taken off from the rail 84 as shown in FIG. 5, the free trolleys 88 are positioned on the link 90 between the plates 96, so that the turn-around motion of the free trolleys 88 are prevented and that the free trolleys 88 are in the position where their directions are the same as that in which the connecting link 90 extends.

What is claimed is:

1. A device for preventing turn-around motions of free trolleys in a power-and-free conveyor having a power rail and a free rail, the device comprising:

(a) a connecting link which interconnects the free trolleys and has holes on the opposite ends thereof;

(b) downwardly directed rods extending from the free trolleys, one from each trolley, each of the rods rotatably and slidably passing through a hole of the connecting link and having a stopper at its lower end, wherein the stopper receives and supports the connecting link when the free trolleys are on the free rail; and (c) turn-preventing means operatively coupled between the free trolleys and the connecting links for preventing rotation of the free trolleys when the connecting link is moved along the rods towards the free trolleys as the free trolleys are removed from the free rail.

2. A device for preventing turn-around motions of the free trolleys as defined in claim 1 wherein each of the turn-preventing means comprises a pair of vertically extending plates arranged in parallel with each other and secured onto one end of the connecting link, wherein the free trolleys are positioned on the connecting link between the plates when the free trolleys are removed from the free rail.

3. A device for preventing turn-around motions of the free trolleys in a power-and-free conveyor having a power rail and a free rail, the device comprising:

(a) a connecting link which interconnects the free trolleys and has holes on the opposite ends thereof;

(b) downwardly directed arms extending from the free trolleys, one from each trolley;

(c) downwardly directed rods extend from the lower portions of the arms, one from each trolley, each of the rods rotatably and slidably passing through a hole of the connecting link and having a stopper at its lower end, wherein the stopper receives and supports the connecting link when the free trolleys are on the free rail; and (d) turn-preventing means operatively coupled between the free trolleys and the connecting links for preventing rotation of the free trolleys when the connecting link is moved along the rods towards the free trolley as the free trolleys are removed from the free rail.

4. A device for preventing turn-around motions of the free trolleys as defined in claim 3 wherein each of the turn-preventing means comprises a horizontal portion formed at the lower end of the arm and an engaging portion which projects downward from the free end of the horizontal portion, and wherein the engaging portion is engageable with the end portion of the connecting link.

5. A device for preventing turn-around motions of the free trolleys as defined in claim 3 wherein each of the turn-preventing means comprises a turn-preventing member secured onto one end of the connecting link, the turn-preventing member comprising a horizontal portion and an engaging portion which extends upward from one end of the horizontal portion, the engaging portion being engageable with the lower portion of the arm.

6. A device for preventing turn-around motions of the free trolleys as defined in claim 3 wherein the connecting link has cylinders at the opposite ends thereof, each of the arms having a horizontal portion at its lower end, each of the rods being secured to the horizontal portion of the arm at its upper end, and each of the turn-preventing means comprising a turn-preventing member secured onto the cylinder, the turn-preventing member comprising a horizontal portion and an engaging portion which extends upward from one end of the horizontal portion, and wherein the holes are formed in the horizontal portion of the turn-preventing member and the cylinder of the connecting link, the engaging member of the turn-preventing member being engageable with the lower portion of the arm.

* * * * *